US010054401B2

(12) United States Patent
Kolvek et al.

(10) Patent No.: US 10,054,401 B2
(45) Date of Patent: Aug. 21, 2018

(54) APPARATUS FOR MOUNTING ACCESSORIES ON A TACTICAL RAIL OF A FIREARM

(71) Applicant: BAE SYSTEMS INFORMATION AND ELECTRONIC SYSTEMS INTEGRATION INC., Nashua, MI (US)

(72) Inventors: Edward M. Kolvek, Merrimac, MA (US); Michael J. Grobecker, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 15 days.

(21) Appl. No.: 15/407,406

(22) Filed: Jan. 17, 2017

(65) Prior Publication Data

US 2018/0202769 A1 Jul. 19, 2018

(51) Int. Cl.
*F41C 27/00* (2006.01)
*F41G 11/00* (2006.01)

(52) U.S. Cl.
CPC ..... *F41G 11/003* (2013.01); *F41C 27/00* (2013.01)

(58) Field of Classification Search
CPC ..... F41G 11/003; F41C 27/00
See application file for complete search history.

(56) References Cited

U.S. PATENT DOCUMENTS

| | | | | |
|---|---|---|---|---|
| 6,773,172 | B1 | 8/2004 | Johnson et al. | |
| 7,370,891 | B1 | 5/2008 | Schmitt et al. | |
| 7,562,484 | B2 | 7/2009 | Kim | |
| 7,739,824 | B1 * | 6/2010 | Swan | F41C 27/00 42/124 |
| 8,112,933 | B1 * | 2/2012 | Swan | F41G 11/003 403/374.5 |
| 8,393,105 | B1 * | 3/2013 | Thummel | F41G 11/003 42/127 |
| 8,397,419 | B2 | 3/2013 | Williams | |
| 8,499,484 | B2 | 8/2013 | Schneider et al. | |
| 8,857,097 | B2 | 10/2014 | Rorick | |
| 9,581,416 | B1 * | 2/2017 | Yim | F41G 11/003 |
| 2006/0207156 | A1 * | 9/2006 | Larue | F41G 11/003 42/127 |
| 2009/0000174 | A1 * | 1/2009 | Davis | F41G 11/003 42/90 |

(Continued)

*Primary Examiner* — Gabriel J. Klein
(74) *Attorney, Agent, or Firm* — Antony P. Ng; Russell Ng PLLC

(57) ABSTRACT

A mounting mechanism is disclosed. The mounting mechanism includes a base, a clamp and a lever. The base includes a lever keeper and a first rail-engaging surface. The clamp includes a second rail-engaging surface. The lever, which includes a lever tab, is connected to the clamp at a pivot to allow an operator to selectively place the clamp in an engaged position or a disengaged position. The lever is configured to move the clamp to the engaged position to allow a rail projection to be secured in a mounting cavity located between the first rail-engaging surface of the base and the second rail-engaging surface of the clamp. When in the engaged position, the lever tab located on the lever is configured to be engaged with the lever keeper located on the base in order to prevent the lever from swinging away from the clamp.

11 Claims, 4 Drawing Sheets

(56) References Cited

U.S. PATENT DOCUMENTS

| | | | | |
|---|---|---|---|---|
| 2012/0181406 | A1* | 7/2012 | Gonzalez | F41G 11/003 248/316.2 |
| 2015/0000172 | A1* | 1/2015 | Oglesby | F41G 11/001 42/90 |
| 2015/0068095 | A1* | 3/2015 | Collin | F41G 11/003 42/90 |

* cited by examiner

APPARATUS FOR MOUNTING ACCESSORIES ON A TACTICAL RAIL OF A FIREARM

TECHNICAL FIELD

The present disclosure relates to mount mechanisms in general, and in particular to a mount mechanism for mounting accessories, such as laser sighting devices, lighting devices, etc., on a tactical rail of a firearm.

BACKGROUND

Rail systems allow various types of accessories, such as laser sights, flashlights, etc., to be attached to a firearm such as a rifle or a pistol. By using a rail system, it is not necessary to attach accessories directly to the barrel of a firearm, which can adversely affect the accuracy of the firearm.

A rail system typically includes a rail platform having a Picatinny rail or a Weaver rail. There are many types of clamping mechanisms designed for mounting accessories on either one or both of the above-mentioned rails. Throw-lever type clamping mechanisms capable of releasable mounting of accessories on a rail of a firearm tend to be the clamping mechanism of choice by military and law enforcement personnel because throw-lever type clamping mechanisms allow them to efficiently change out accessories under field conditions without losing the aim-point (or zero) of the firearm or accessories.

However, a throw-lever type clamping mechanism may become loosened when the associated firearm is subjected to significant vibration and rough use. If a throw-lever of the clamping mechanism becomes too loose and rotates to a release position inadvertently, the attached accessory will also be loosened to the extent that it may fall off from the firearm. Needless to say, it can be extremely hazardous to an operator of the firearm if the above-mentioned situation occurs under tactical field conditions.

Consequently, it would be desirable to provide an improved throw-lever type clamping mechanism for mounting accessories on a rail of a firearm.

SUMMARY

In accordance with one embodiment of the present disclosure, a mounting mechanism for mounting accessories on a rail of a firearm includes a base, a clamp and a lever. The base includes a lever keeper and a first rail-engaging surface. The clamp includes a second rail-engaging surface. The lever, which includes a lever tab, is connected to the clamp at a pivot to allow an operator to selectively place the clamp in an engaged position or a disengaged position. The lever is configured to move the clamp to the engaged position to allow a rail projection to be secured in a mounting cavity located between the first rail-engaging surface of the base and the second rail-engaging surface of the clamp. When in the engaged position, the lever tab located on the lever is configured to be engaged with the lever keeper located on the base in order to prevent the lever from swinging away from the clamp. The lever is also configured to move the clamp to the disengaged position to allow the rail projection to be released from the mounting cavity. A force is needed to be applied against a spring within the lever before the lever can be swung away from the clamp.

The features and advantages described herein are not all-inclusive and, in particular, many additional features and advantages will be apparent to one of ordinary skill in the art in view of the drawings, specification and claims. Moreover, it should be noted that the language used in the specification has been selected principally for readability and instructional purposes and not to limit the scope of the inventive subject matter.

BRIEF DESCRIPTION OF THE DRAWINGS

The invention itself, as well as its modes of use, further objects, and advantages thereof, will best be understood by reference to the following detailed description of an illustrative embodiment when read in conjunction with the accompanying drawings, wherein.

DETAILED DESCRIPTION

Figure 1:
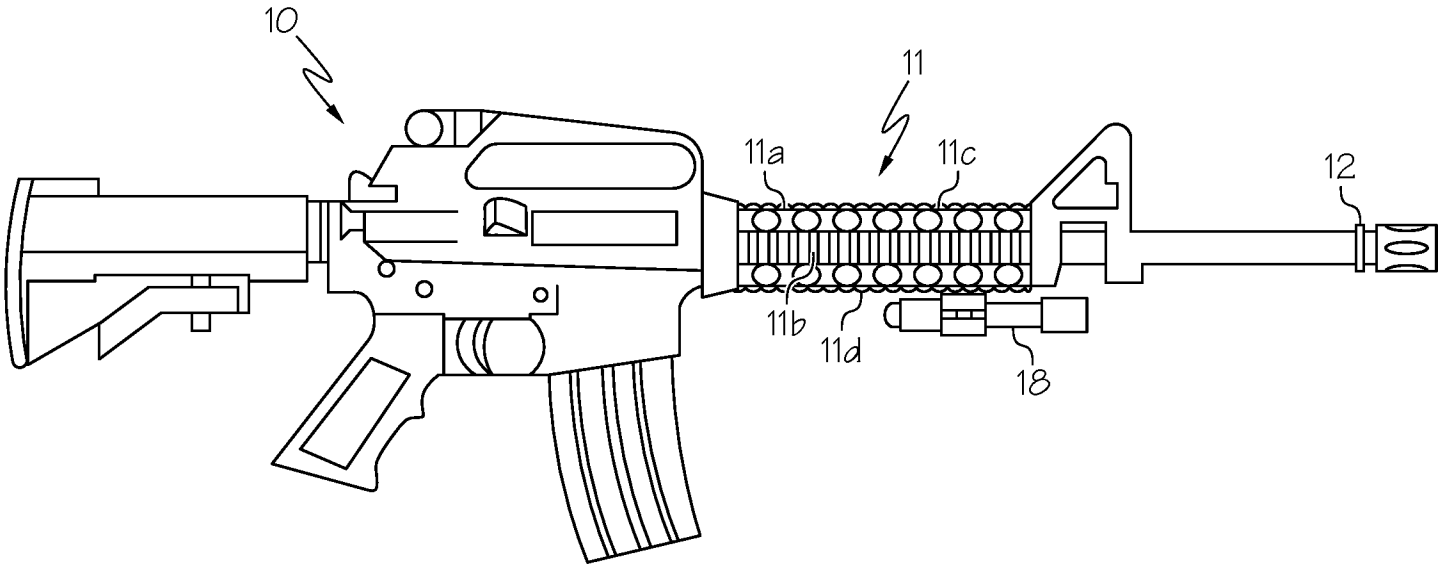
FIG. 1 is a side view of a rifle having a rail system on which a mounting mechanism can be attached.

Referring now to the drawings and in particular to FIG. 1, there is illustrated a side view of a rifle having a rail system on which a mounting mechanism can be attached. As shown, a rifle 10 includes a rail system 11 having a top rail platform 11*a*, side rail platforms 11*b*-11*c* and a bottom rail platform 11*d*. While top rail platform 11*a*, side rail platforms 11*b*-11*c* and bottom rail platform 11*d* are carried by rail system 11, some of rail platforms 11*a*-11*d* may be removed as desired. Each of rail platforms 11*a*-11*d* provides multiple rail projections that are conformed to known rail standards, such as Picatinny rails or Weaver rails having shapes and dimensions that are well-known in the art. Rail system 11 can be secured to rifle 10 by various structures and methods known to those skilled in the art. While rail system 11 is shown to be attached to a barrel 12 of rifle 10, rail system 11 can be attached to other parts of rifle 10 or to other types of firearms such as pistols. Various accessories, such as laser sights, flashlights and other tactical devices, can be mounted on any one of rail platforms 11*a*-11*d*. For example, a flashlight 18 is shown to be mounted on bottom rail platform 11*d*.

Figure 2A:
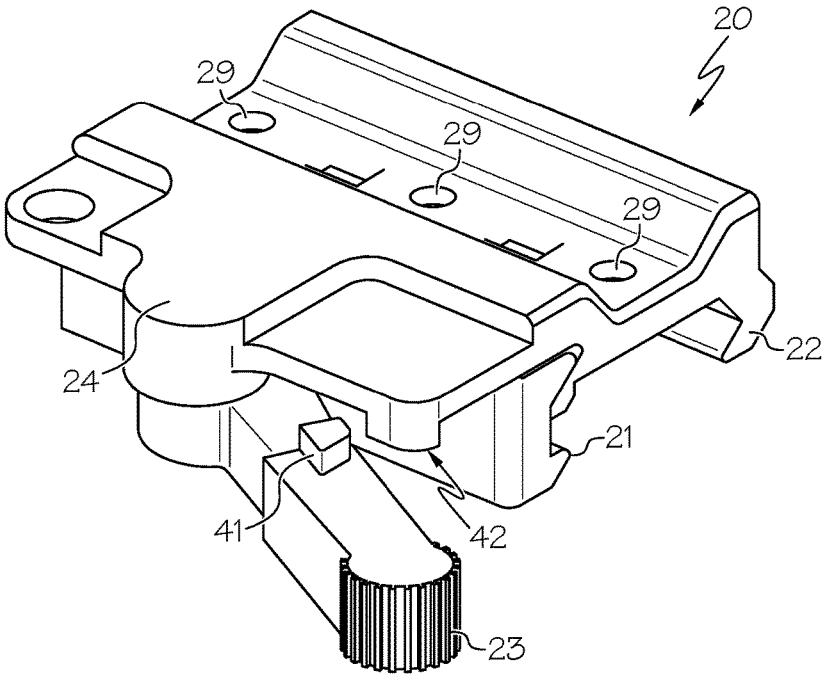
FIGS. 2A and 2B are an isometric view and a front view of a mounting mechanism in a disengaged position, respectively, according to one embodiment.
Figure 2B:
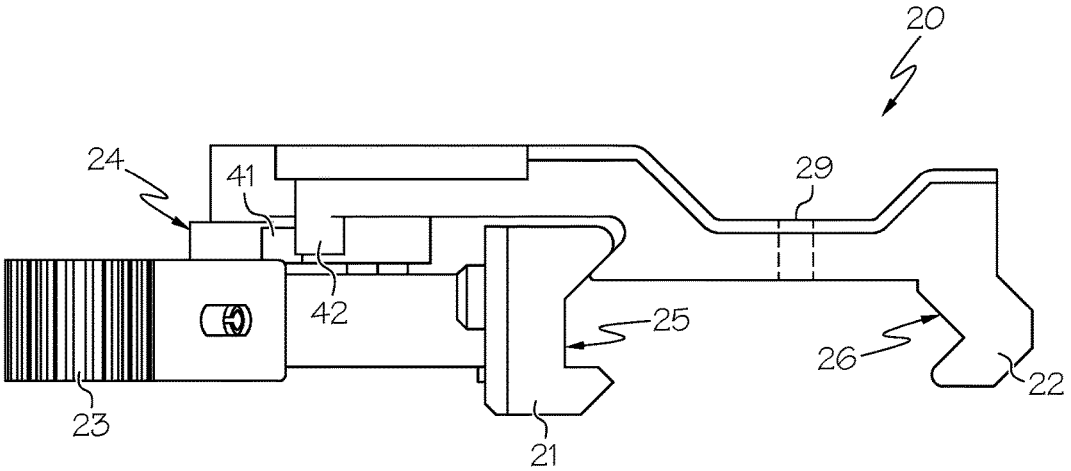

With reference now to FIGS. 2A-2B, there are illustrated an isometric view and a front view, respectively, of a mounting mechanism for mounting accessories on a rail system, such as rail system 11 from FIG. 1, according to one embodiment. As shown, a mounting mechanism 20 includes a clamp 21, a base 22 and a lever 23. Clamp 21 includes a rail-engaging surface 25, and base 22 includes a rail-engaging surface 26. The space between rail-engaging surface 25 and rail-engaging surface 26 can be described as a mounting cavity for receiving a rail projection. Mounting mechanism 20 is shown in a disengaged position in FIGS. 2A-2B.

Each one of rail platforms 11*a*-11*d* from FIG. 1 includes multiple rail projections, each separated from the next by evenly spaced transverse slots. The spacings between rail projections depend of the types of rails, such as Picatinny rails or Weaver rails. Each of the rail projections is defined by an upper mounting surface and a lower mounting surface, which are disposed in angulated relation with one another. Mounting mechanism 20 can be mounted on a rail platform by positioning a rail projection within the mounting cavity located between rail-engaging surface 25 of clamp 21 and rail-engaging surfaces 26 of base 22.

Clamp 21 can be connected to base 22 via a mechanical slide or guide. Lever 23 is attached to base 22 via a pivot 24. Pivot 24 may include a pin that connects lever 23 to base 22. Lever 23 is also connected to clamp 21 to allow an operator to move lever 23 in order to position clamp 21 from a disengaged position to an engaged position, and vice versa. In the disengaged position, as shown in FIGS. 2A-2B, lever 23 is positioned away from clamp 21, and a rail projection may be placed within or removed from the mounting cavity of mounting mechanism 20.

Figure 3A:
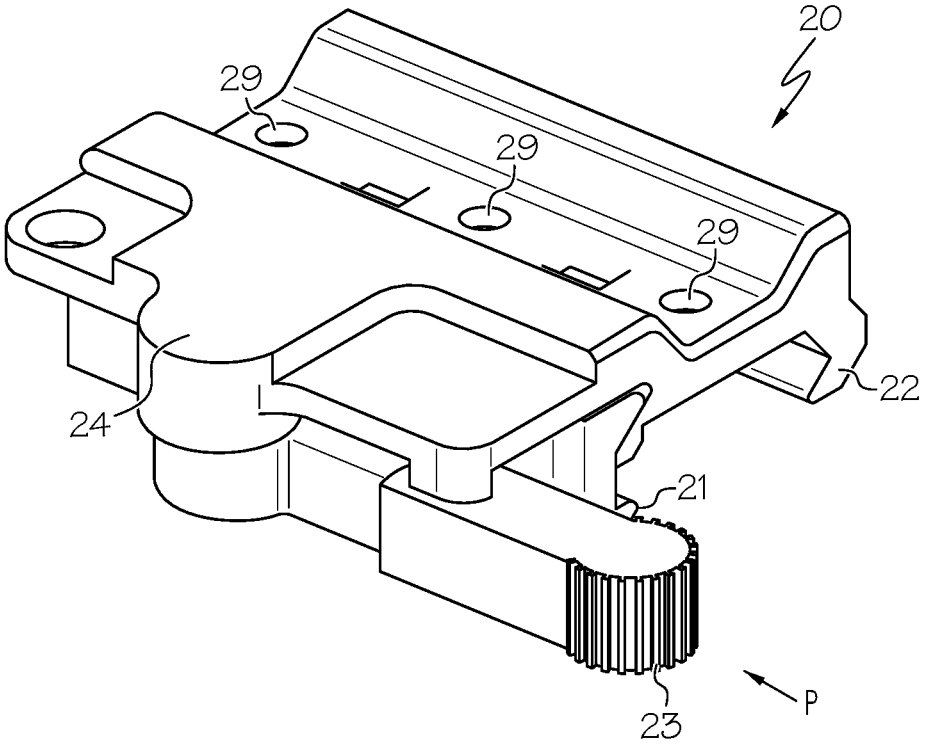
FIGS. 3A and 3B are an isometric view and a front view of the mounting mechanism from FIGS. 2A-2B, respectively, in an engaged position.
Figure 3B:
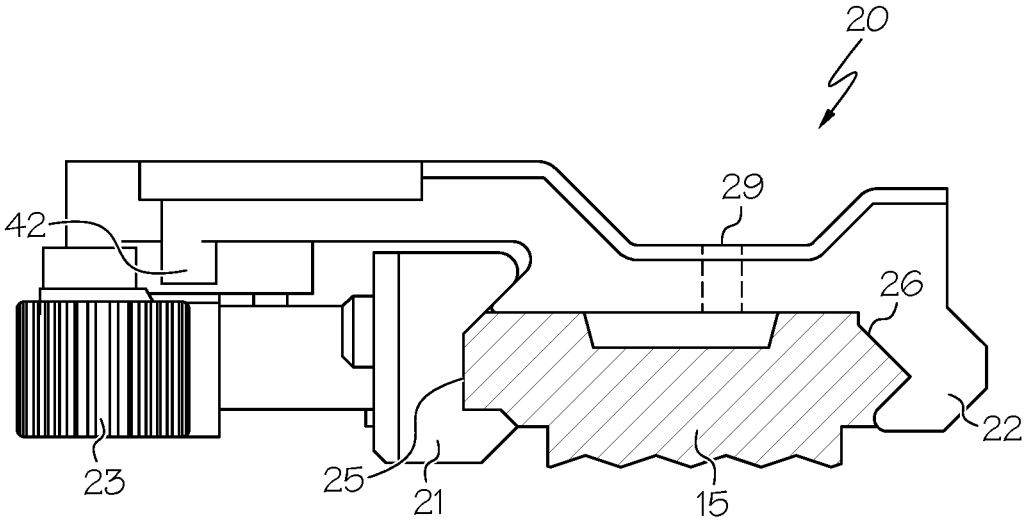

In the engaged position, as shown in FIGS. 3A-3B, lever 23 is positioned adjacent to clamp 21. In addition, rail-engaging surface 25 of clamp 21 engages the mounting surface on one side of a rail projection 15, and rail-engaging surface 26 of base 22 engages the mounting surface on the other side of rail projection 15, as shown in FIG. 3B.

A lever tab 41 is located on lever 23, and a lever keeper 42 is located on base 22. Lever keeper 42 is configured to be engaged with lever tab 41 when lever 23 is in an engaged position. Specifically, lever keeper 42 prevents lever 23 from swinging away from clamp 21, whether inadvertently or not. The combination of lever tab 41 and lever keeper 42 ensure that lever 23 maintains a secure engagement with clamp 21 during the engaged position.

Base 22 also includes multiple holes 29 to allow an accessory, such as a scope ring for securing a scope, to be attached to base 22 via multiple screws (not shown). It is understood by those skilled in the art that a specific type of attachment other than a ring can be employed for securing a specific type of accessory to base 22.

An operator can attach mounting mechanism 20 (along with an accessory) onto a rail platform quickly and easily. The operator initially positions mounting mechanism 20 at a desired point on rail platform 11*a* (or one of other rail platforms 11*b*-11*d*). To position mounting mechanism 20 on rail platform 11*a*, clamp 21 is brought into its disengaged position (i.e., lever 23 away from clamp 21). After the desired point on rail platform 11*a* has been reached, the operator can swing lever 23 towards clamp 21 in order to secure mounting mechanism 20 on rail platform 11*a*. At this point, lever keeper 42 is located in the locus of lever tab 41 such that lever 23 is not allowed to swing away from clamp 21.

Figure 4:
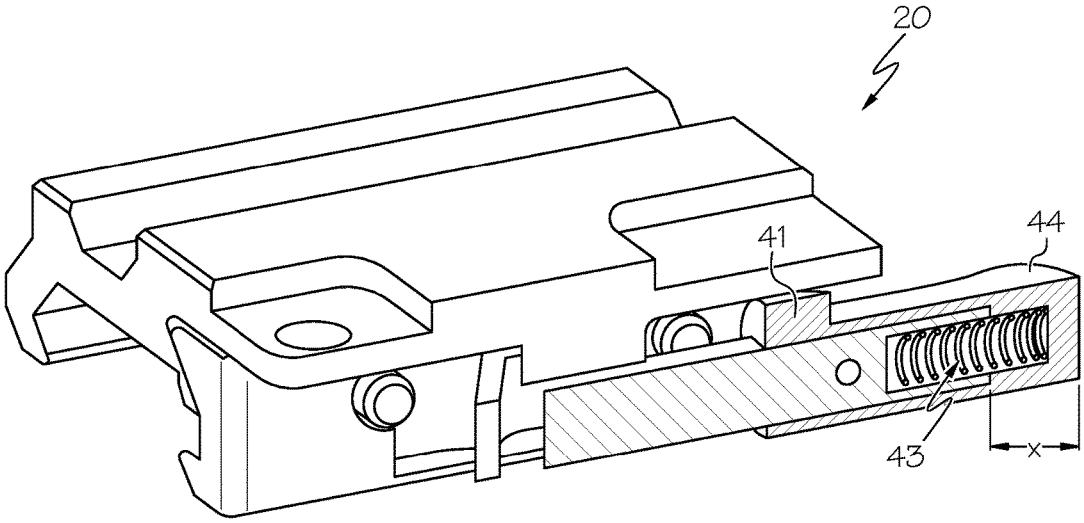
FIG. 4 shows a cutout view of a lever for the mounting mechanism from FIG. 2A.

With reference now FIG. 4, there is illustrated a cutout view of lever 23, according to one embodiment. As shown, lever 23 includes a lever cover 44 and a spring 43 that is located inside lever 23. The tension of spring 43 is approximately 5 pounds in this example. Lever tab 41 is located on lever cover 44. Lever cover 44 can travel along lever 23 for a distance of x.

When an operator desires to un-mount mounting mechanism 20 from a rail platform, the operator needs to initially push lever cover 44 by using a thumb or forefinger in the direction of P (also shown in FIG. 3A) to compress spring 43 in order to release lever tab 41 from lever keeper 42, and the operator can then swing lever 23 away from clamp 21. This brings clamp 21 into its disengaged position. At this point, the operator can release mounting mechanism 20 from a rail projector, such as rail projector 15 in FIG. 3B.

Alternatively, a different type of spring can be placed within lever 23 such that the operator can release lever tab 41 from lever keeper 42 by pulling lever cover 44 with a thumb and a forefinger in a direction opposite of P to actuate (elongate) the spring.

Figure 5:
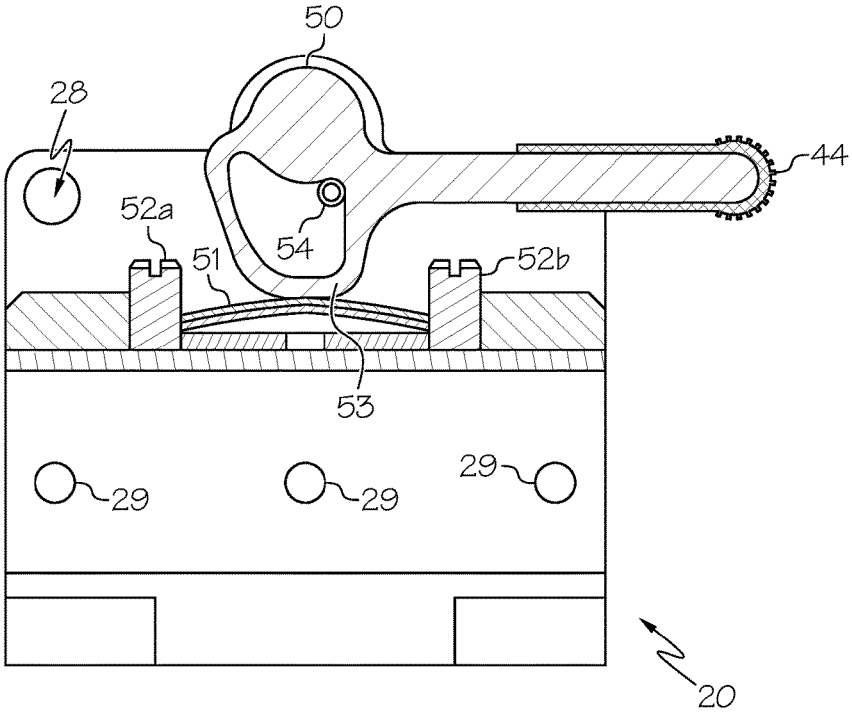
FIG. 5 is a bottom view of the mounting mechanism from FIG. 2A.

Referring now to FIG. 5, there is illustrated a bottom view of mounting mechanism 20, according to one embodiment. As shown, mounting mechanism 20 includes holes 29 viewing from the direction of the mounting cavity. Mounting mechanism 20 also includes a hole 28 as a tie point for a lanyard or a piece of rope as a redundancy feature to guard against loss if mounting mechanism 20 (along with an attached accessory) ever comes loose. Lever 23 is a self-locking lever having an over-center cam 50 that includes a cam surface 53 and a cam stop 54. Cam stop 54 allows lever 23 to stop at two separate positions—the engaged position and the disengaged position. As lever 23 is being rotated, cam surface 53 travels on the surface of a compliant leaf spring 51 that is mounted between posts 52*a* and 52*b* located on base 22.

As has been described, the present disclosure provides an improved mounting mechanism for mounting accessories on a tactical rail of a firearm that can positively secure a throw-lever at its clamping position.

While the invention has been particularly shown and described with reference to a preferred embodiment, it will be understood by those skilled in the art that various changes in form and detail may be made therein without departing from the spirit and scope of the invention.

What is claimed is:

1. A mounting mechanism for mounting accessories on at least one rail of a firearm, said mounting mechanism comprising:

a base having a first rail-engaging surface;

a clamp having a second rail-engaging surface;

a lever keeper located on said base;

a lever tab;

a lever connected to said clamp at a pivot, wherein said lever includes a spring lying along said longitudinal axis of said lever; and a lever cover, on which said lever tab is located, slides along a longitudinal axis of said lever to actuate said spring to allow an operator to selectively place said clamp in one of an engaged position and a disengaged position, wherein said lever is configured to move said clamp to said engaged position to secure a rail projection in a mounting cavity located between said first rail-engaging surface of said base and said second rail-engaging surface of said clamp, wherein said lever tab engages with said lever keeper in order to prevent said lever from swinging away from said clamp during said engaged position, wherein said lever is configured to move said clamp to said disengaged position to release said rail projection from said mounting cavity by said operator pulling said lever cover in a direction away from said pivot to elongate said spring to release said lever tab from said lever keeper before swinging said lever away from said clamp.

2. The mounting, mechanism of claim 1, wherein said lever cover covers one end of said lever.

3. The mounting mechanism of claim 1, wherein said lever is configured to move said clamp to said disengaged position to release said rail projection from said mounting cavity by said operator pushing said lever cover to compress said spring to release said lever tab from said lever keeper before swinging said lever away from said clamp.

4. The mounting mechanism of claim 1, wherein said base includes a plurality of mounting holes to allow an accessory to be attached to said mounting mechanism via screws.

5. The mounting mechanism of claim 1, wherein said lever is connected to said base at a pivot.

6. The mounting mechanism of claim 5, wherein said lever is a self-locking lever having a over-center cam that includes a cam surface and a cam stop.

7. The mounting mechanism of claim 6, wherein said cam stop allows said lever to stop at one of said engaged position and said disengaged position.

8. The mounting mechanism of claim 6, wherein said cam surface travels on a surface of a compliant leaf spring mounted on said base.

9. A firearm, comprising:

at least one rail platform coupled to said firearm; and a mounting mechanism engaged to said rail platform, wherein said mounting mechanism includes:

a base having a first rail-engaging surface;

a clamp having a second rail-engaging surface;

a lever keeper located on said base;

a lever tab;

a lever connected to said clamp at a pivot, wherein said lever includes a spring lying along a longitudinal axis of said lever; and a lever cover, on which said lever tab is located, slides along said longitudinal axis of said lever to activate said spring to allow an operator to selectively place said clamp in one of an engaged position and a disengaged position, wherein said lever is configured to move said clamp to said engaged position to secure a rail projection in a mounting cavity located between said first rail-engaging surface of said base and said second rail-engaging surface of said clamp, wherein said lever tab engages with said lever keeper in order to prevent said lever from swinging away from said clamp during said engaged position, wherein said lever is configured to move said clang to said disengaged position to release said rail projection from said mounting cavity by said operator pulling said lever cover in a direction away from said pivot to elongate said spring to release said lever tab from said lever keeper before swinging said lever away from said clamp.

10. The firearm of claim 9, wherein said lever cover covers one end of said lever.

11. The firearm of claim 9, wherein said lever is configured to move said clamp to said disengaged position to release said rail projection from said mounting cavity by said operator pushing said lever cover to compress said spring to release said lever tab from said lever keeper before swinging said lever away from said clamp.

* * * * *